US009488135B2

(12) United States Patent
Yamashita et al.

(10) Patent No.: US 9,488,135 B2
(45) Date of Patent: Nov. 8, 2016

(54) FLOW RATE CONTROLLER OF INTERNAL COMBUSTION ENGINE

(75) Inventors: Akira Yamashita, Sunto-gun (JP); Kazuhiro Mori, Sunto-gun (JP); Koichiro Nakatani, Mishima (JP); Hisashi Ohki, Numazu (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 214 days.

(21) Appl. No.: 14/385,080

(22) PCT Filed: Apr. 12, 2012

(86) PCT No.: PCT/JP2012/060034

§ 371 (c)(1),
(2), (4) Date: Sep. 12, 2014

(87) PCT Pub. No.: WO2013/153654

PCT Pub. Date: Oct. 17, 2013

(65) Prior Publication Data

US 2015/0027421 A1 Jan. 29, 2015

(51) Int. Cl.

| | |
|---|---|
| ***F02D 41/14*** | (2006.01) |
| ***F02D 41/00*** | (2006.01) |
| ***F02M 25/07*** | (2006.01) |
| ***F02D 41/12*** | (2006.01) |

(52) U.S. Cl.

CPC ..... *F02M 25/0771* (2013.01); *F02D 41/123* (2013.01); *F02D 41/0007* (2013.01); *F02D 41/0065* (2013.01); *F02D 41/126* (2013.01); *F02D 2041/1472* (2013.01);

(Continued)

(58) Field of Classification Search

CPC ..... F02D 41/123; F02D 41/0065; F02D 41/126; F02D 41/0007; F02D 41/0077; F02D 41/0047; F02D 41/0055; F02D 2041/1472; F02D 2200/0018; F02M 26/50; F02M 26/33; F02M 26/35; Y02T 10/121

USPC ..... 123/568.21

See application file for complete search history.

(56) References Cited

U.S. PATENT DOCUMENTS

2004/0060549 A1* 4/2004 Kobayashi ..... F02M 26/32 123/568.21

2005/0021217 A1 1/2005 Bhargava et al.

(Continued)

FOREIGN PATENT DOCUMENTS

JP 2003-206793 A 7/2003

JP 2007-016611 A 1/2007

(Continued)

*Primary Examiner* — Stephen K Cronin

*Assistant Examiner* — George Jin

(74) *Attorney, Agent, or Firm* — Andrews Kurth Kenyon LLP

(57) ABSTRACT

A flow rate controller of an internal combustion engine includes a flow rate change section configured by including an EGR valve, a bypass valve, and a diesel throttle, as the flow rate change section capable of changing at least one of a flow rate of exhaust gas that is recirculated to an intake system from an exhaust system of an internal combustion engine via an EGR passage and a flow rate of fresh air that flows into the internal combustion engine. In addition, an ECU is included to realize: an arrival position determining section for determining an arrival position of condensed water in the EGR passage that is moved by the EGR at least either at the time of acceleration or at the time of deceleration of the internal combustion engine; and a control section for controlling the flow rate change section on the basis of the arrival position determined by the arrival position determining section.

7 Claims, 5 Drawing Sheets

(52) U.S. Cl.
CPC ..... *F02M 26/05* (2016.02); *F02M 26/21* (2016.02); *F02M 26/22* (2016.02); *F02M 26/25* (2016.02); *F02M 26/50* (2016.02); *F02M 2026/004* (2016.02)

(56) References Cited

U.S. PATENT DOCUMENTS

2009/0308071 A1* 12/2009 Yamashita ..... F02B 29/0418 60/602
2014/0352663 A1* 12/2014 Glugla ..... F02D 41/0085 123/443
2015/0337745 A1* 11/2015 MacNeille ..... F02D 37/02 123/406.48

FOREIGN PATENT DOCUMENTS

JP 2007291973 A 11/2007
JP 2008-163953 A 7/2008

* cited by examiner

FLOW RATE CONTROLLER OF INTERNAL COMBUSTION ENGINE

CROSS-REFERENCE TO RELATED APPLICATIONS

This is a national phase application based on the PCT International Patent Application No. PCT/jp2013/060034 filed Apr. 12, 2012, the entire contents of which is incorporated herein by reference.

TECHNICAL FIELD

The present invention relates to a flow rate controller of an internal combustion engine.

BACKGROUND ART

For example, Patent Document 1 discloses a technique that is related to the present invention and relates to a flow rate controller of an internal combustion engine for adjusting at least one of a flow rate of exhaust gas that is recirculated to an intake system from an exhaust system of the internal combustion engine via an exhaust gas recirculation (EGR) passage and a flow rate of fresh air that flows into the internal combustion engine. Patent Document 1 discloses a controller of a diesel engine that fully closes an intake throttle valve in a fuel cut state of the engine and fully opens an EGR valve. Thus, fresh air flows as is into an exhaust passage in the fuel cut state. Consequently, the controller is adapted to suppress a reduction in a temperature of exhaust gas purifying means, thereby maintaining exhaust gas purification performance.

PRIOR ART DOCUMENT

Patent Document

Patent Document 1: Japanese Patent Application Publication No. 2007-16611 (JP 2007-16611 A)

SUMMARY OF THE INVENTION

Problem to be Solved by the Invention

There is a case where moisture contained in the exhaust gas is condensed in the EGR passage that recirculates the exhaust gas to the intake system from the exhaust system of the internal combustion engine. Then, there is also a case where thus-produced condensed water is moved by EGR at the time of acceleration or deceleration of the internal combustion engine and flows into a cylinder of the internal combustion engine. In regard to this point, the condensed water, which has flown into the cylinder, can eventually be evaporated and discharged from the cylinder.

However, when there is inflow of the condensed water, the condensed water is likely to be temporarily adhered to various parts inside the cylinder in comparison with a case where there is no inflow of the condensed water. Also in this case, depending on stop timing of the internal combustion engine, the condensed water, which has flown into the cylinder, may remain in the cylinder as is or in a temporarily evaporated state, or may be adhered to the various parts of the cylinder. Then, NOx or SOx is dissolved into the condensed water, and strong acid is thereby generated. Thus, when there is the inflow of the condensed water, the various parts inside the cylinder may tend to be corroded. Consequently, in the internal combustion engine that includes a fuel injection valve for directly injecting fuel into the cylinder, for example, an injection opening of the fuel injection valve may tend to be corroded. Alternatively, combustion may become unstable due to the inflow of the condensed water at the time of reinjection of the fuel.

In view of the above problem, the present invention has an object to provide a flow rate controller of the internal combustion engine capable of suppressing condensed water in an EGR passage from flowing into a cylinder of the internal combustion engine.

Means for Solving the Problem

The present invention is a flow rate controller of an internal combustion engine that includes: a flow rate change section capable of changing at least one of a flow rate of exhaust gas that is recirculated to an intake system from an exhaust system of the internal combustion engine via an EGR passage and a flow rate of fresh air that flows into the internal combustion engine; an arrival position determining section for determining an arrival position of condensed water in the EGR passage that is moved by EGR at least either at the time of acceleration or at the time of deceleration of the internal combustion engine; and a control section for controlling the flow rate change section on the basis of the arrival position determined by the arrival position determining section.

The present invention can be configured that, of the time of acceleration and the time of deceleration of the internal combustion engine, the arrival position determining section determines the arrival position of the condensed water in the EGR passage that is moved by the EGR at the time of deceleration of the internal combustion engine that is accompanied by fuel cut.

The present invention can be configured that an EGR device for forming the EGR passage is provided, that, of a recirculate passage section that connects the exhaust system and the intake system, a flow rate adjusting valve that adjusts a flow rate of exhaust gas flowing into the intake system via the recirculate passage section, a cooler that cools the exhaust gas distributed in the recirculate passage section, a bypass passage section that bypasses the cooler out of the flow rate adjusting valve and the cooler, and a bypass valve that adjustably switches a distribution passage to at least one of the cooler and the bypass passage section, the EGR device at least includes the recirculate passage section, the flow rate adjusting valve, and the cooler, and that the flow rate change section is configured by having at least one of the flow rate adjusting valve and the bypass valve and is also configured by having at least one of a throttle valve that can adjust an intake air amount of the internal combustion engine, an exhaust driven and variable capacity turbocharger that can supercharge the internal combustion engine, and an exhaust throttle valve that can adjust a flow rate of the exhaust gas discharged from the internal combustion engine:

Effect of the Invention

According to the present invention, it is possible to suppress condensed water in an EGR passage from flowing into a cylinder of an internal combustion engine.

MODES FOR CARRYING OUT THE INVENTION

An embodiment of the present invention will be described by using the accompanying drawings.

Figure 1:
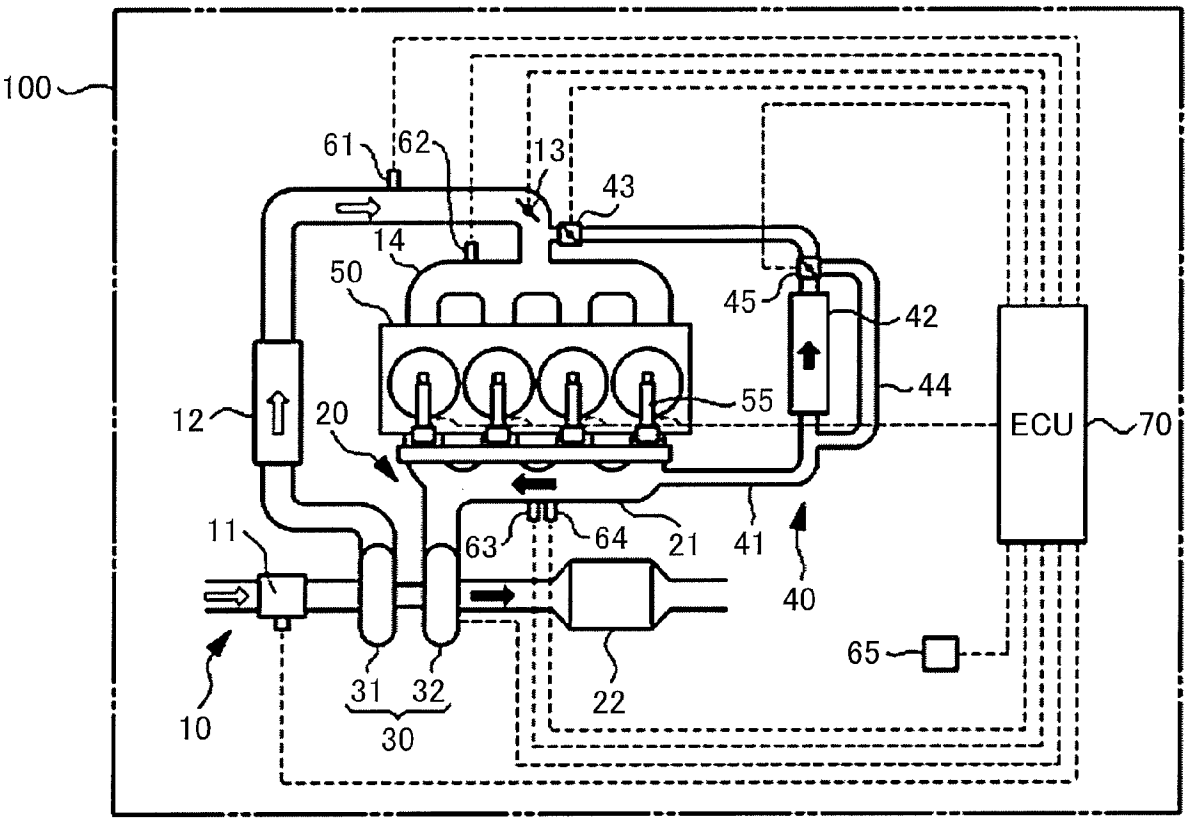
FIG. 1 is a schematic configuration view of a vehicle.

FIG. 1 is a schematic configuration view of a vehicle 100. An internal combustion engine 50 is mounted in the vehicle 100. The vehicle 100 can be a vehicle that can automatically stop an operation of the internal combustion engine 50 (a vehicle that can perform idle stop) while traveling thereof is stopped, for example. Alternatively, the vehicle 100 can be a hybrid vehicle that has the internal combustion engine 50 and a power unit other than the internal combustion engine 50 (such as a regenerative motor) as power sources.

The internal combustion engine 50 is an internal combustion engine of compression ignition type (such as a diesel engine). Thus, the internal combustion engine 50 includes a fuel injection valve 55 that directly injects fuel into a cylinder. Meanwhile, the internal combustion engine 50 may be an internal combustion engine of spark ignition type, for example. The internal combustion engine 50 may be an internal combustion engine that performs fuel injection several times (multi-stage injection) in each combustion cycle in the each cylinder. In addition to the internal combustion engine 50, an intake system 10, an exhaust system 20, a supercharger 30, an EGR device 40, and an ECU 70 are mounted in the vehicle 100.

The intake system 10 includes an airflow meter 11, an inter cooler 12, a diesel throttle 13, and an intake manifold 14. The airflow meter 11 measures an intake air amount of the internal combustion engine 50. The inter cooler 12 cools intake air of the internal combustion engine 50. The diesel throttle 13 adjusts the intake air amount of the internal combustion engine 50, so as to adjust a flow rate of fresh air that flows into the internal combustion engine 50. The diesel throttle 13 is specifically an electronically controlled throttle valve. The intake manifold 14 distributes the intake air to the each cylinder of the internal combustion engine 50. The exhaust system 20 includes an exhaust manifold 21 and a catalyst 22. Exhaust gas from the each cylinder of the internal combustion engine 50 is converged in the exhaust manifold 21. The catalyst 22 purifies the exhaust gas.

The supercharger 30 supercharges the intake air in the internal combustion engine 50. The supercharger 30 is an exhaust driven supercharger and includes a compressor section 31 and a turbine section 32. The compressor section 31 and the turbine section 32 are respectively provided to be interposed in the intake system 10 and the exhaust system 20. Thus, the compressor section 31 of the supercharger 30 constitutes a part of the intake system 10, while the turbine section 32 thereof constitutes a part of the exhaust system 20. The supercharger 30 is specifically a variable capacity turbocharger and includes a variable nozzle in the turbine section 32, the variable nozzle being capable of changing a flow rate of the exhaust gas that flows thereinto. The supercharger 30 changes an opening amount of the variable nozzle and thus can change a turbine capacity.

The EGR device 40 includes an EGR pipe 41, an EGR cooler 42, an EGR valve 43, a bypass pipe 44, and a bypass valve 45. The EGR device 40 forms the EGR passage. The EGR pipe 41 is a recirculate passage section and connects the intake system 10 and the exhaust system 20. The EGR pipe 41 is provided with the EGR cooler 42 and the EGR valve 43. The EGR pipe 41 may be configured by having a plurality of pipes.

The EGR cooler 42 is a cooler and cools the exhaust gas to be recirculated (hereinafter referred to as EGR gas). The EGR cooler 42 is specifically a heat exchanger that performs heat exchange between cooling water of the internal combustion engine 50 and the EGR gas, thereby cooling the EGR gas. The EGR valve 43 is a flow rate adjusting valve and adjusts a flow rate of the EGR gas. The EGR valve 43 is provided in a portion on the downstream side in the EGR pipe 41. This portion is a portion on a downstream side of the EGR cooler 42 in the EGR pipe 41. The EGR valve 43 is specifically provided in an end portion on the intake system 10 side of the EGR pipe 41.

The bypass pipe 44 is a bypass passage section and is connected to the EGR pipe 41, so as to bypass the EGR cooler 42 out of the EGR cooler 42 and the EGR valve 43. The bypass pipe 44 has a passage that is narrower than the EGR cooler 42. The bypass valve 45 is provided in a merging section where the EGR pipe 41 and the bypass pipe 44 are merged, and switches a distribution channel such that the distribution channel can be adjusted to at least one of the EGR cooler 42 and the bypass pipe 44. The bypass valve 45 increases a ratio of valve opening on one side of the EGR cooler 42 and the bypass pipe 44 to be larger than a ratio of valve opening on another side, and thus can distribute the exhaust gas preferentially to either one of the EGR cooler 42 and the bypass pipe 44.

The ECU 70 is an electronic control unit, and the diesel throttle 13, the supercharger 30, the EGR valve 43, the bypass valve 45, and the fuel injection valve 55 as control subjects are electrically connected to the ECU 70. In addition to the airflow meter 11, an intake air temperature sensor 61, an intake air pressure sensor 62, an exhaust gas temperature sensor 63, an exhaust gas pressure sensor 64 are electrically connected as sensor switches to the ECU 70. The intake air temperature sensor 61 and the intake air pressure sensor 62 are provided to respectively detect a temperature and a pressure of the intake air in a portion of the intake system 10 where the EGR pipe 41 is connected, while the exhaust gas temperature sensor 63 and the exhaust gas pressure sensor 64 are provided to detect a temperature and a pressure of the exhaust gas in a portion of the exhaust system 20 where the EGR pipe 41 is connected.

In addition to the above-mentioned components, a sensor group 65 for detecting operation states of the internal combustion engine 50 and the vehicle 100 is electrically connected to the ECU 70. The sensor group 65 includes a crank sensor capable of detecting a speed of the internal combustion engine 50, an accelerator pedal operation amount sensor for detecting a depressing amount of an accelerator pedal that requests acceleration to the internal combustion engine 50, a coolant temperature sensor for detecting a temperature of the cooling water in the internal combustion engine 50, an ignition switch for starting the internal combustion engine 50, and a vehicle speed sensor capable of detecting a vehicle speed. Output of the sensor group 65 and various types of information based on the output of the sensor group 65 may be obtained through an ECU for controlling the internal combustion engine 50, for example. Alternatively, the ECU 70 may serve as the ECU for controlling the internal combustion engine 50.

In the ECU 70, based on a program that is stored in a ROM, a CPU executes a process by using a temporary storage area of a RAM upon necessity. Accordingly, various function sections such as an arrival position determining section, which will be described next, are realized.

The arrival position determining section determines an arrival position of the condensed water in the EGR passage that is moved by EGR at least either at the time of acceleration or at the time of deceleration of the internal combustion engine 50. Of the time of acceleration and the time of deceleration of the internal combustion engine 50, the arrival position determining section can be configured to determine the arrival position of the condensed water in the EGR passage that is moved by the EGR at the time of deceleration of the internal combustion engine 50 that is accompanied by fuel cut. The arrival position determining section specifically estimates the arrival position of the condensed water, so as to determine the arrival position of the condensed water.

Figure 2:
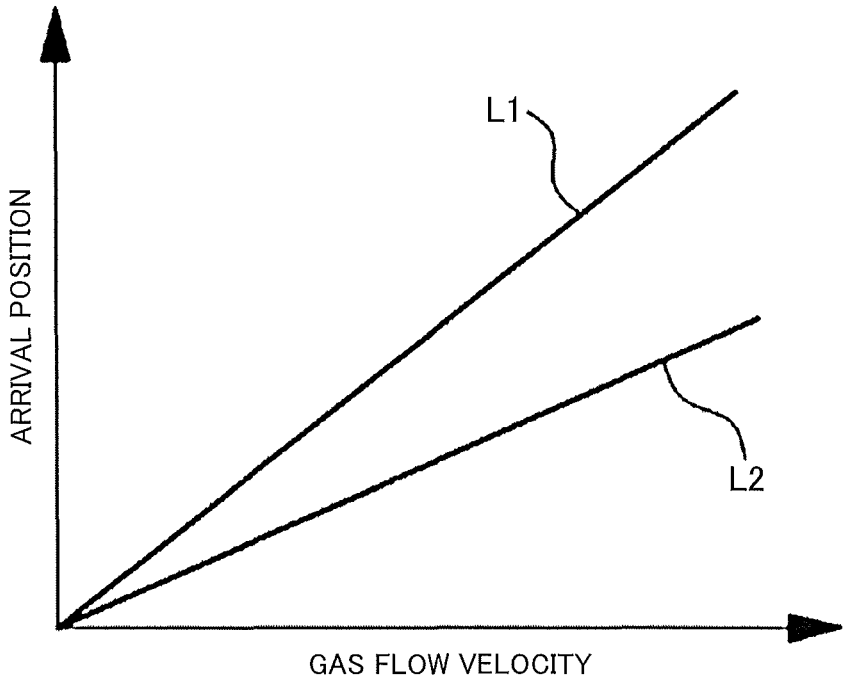
FIG. 2 is a graph for showing a changing trend of an arrival position of condensed water.

FIG. 2 is a graph for showing a changing trend of the arrival position of the condensed water. A vertical axis indicates the arrival position, and a horizontal axis indicates a gas flow velocity. A linear line L1 represents a case where an amount of the condensed water is relatively large among the linear lines L1, L2, while the linear line L2 represents a case where the amount of the condensed water is relatively small among the linear lines L1, L2. As shown in FIG. 2, the arrival position of the condensed water reaches far as the gas flow velocity is increased. In addition, the arrival position of the condensed water reaches far as the amount of the condensed water is increased.

Thus, the arrival position determining section specifically estimates the arrival position of the condensed water in accordance with a gas flow velocity u that is applied to the condensed water in the EGR passage and the amount of the condensed water in the EGR passage.

The flow velocity u is at least a flow velocity u1 of the flow velocity u1 and a flow velocity u2, the flow velocity u1 being an average flow velocity of the EGR gas and the flow velocity u2 being an average flow velocity of mixed gas of the fresh air and the EGR gas. The flow velocity u can be expressed by the following expression (1).

$$u=V/A \tag{1}$$

Here, V is a volumetric flow rate, and A is a cross sectional area of the passage. The volumetric flow rate V can be obtained by dividing a mass flow rate m by a fluid density ρ. In addition, the fluid density ρ can be replaced by a fluid pressure P. Thus, the flow velocity u can be estimated on the basis of the output of the airflow meter 11, the intake air/exhaust gas temperature sensors 61, 63, and the intake air/exhaust gas pressure sensors 62, 64.

The amount of the condensed water can be set as an amount of the condensed water at a specified position. In regard to this point, the amount of the condensed water at the specified position is changed in accordance with the operation state of the internal combustion engine 50. Thus, the amount of the condensed water at the specified position can be estimated by integrating an increasing/reducing amount of the condensed water at the specified position that is increased or reduced in accordance with the operation state of the internal combustion engine 50. Furthermore, the increasing/reducing amount can be grasped in advance in accordance with the operation state of the internal combustion engine 50 by a bench test, for example. Thus, the increasing/reducing amount can be set in advance as map data in accordance with the operation state of the internal combustion engine 50.

As the operation state of the internal combustion engine 50, a parameter that affects the increasing amount of the condensed water and a parameter that affects the reducing amount can be used. As the parameter that affects the increasing amount, for example, a parameter by which it is possible to determine how long a state that a passage wall temperature is lower than a dew point of the moisture contained in the EGR gas persists (for example, the temperature of the cooling water in the internal combustion engine 50) can be used. As the parameter that affects the reducing amount, for example, a parameter by which it is possible to determine how long a state that the passage wall temperature is higher than the dew point persists (for example, the temperature of the cooling water in the internal combustion engine 50) can be used. In addition, a parameter that defines an execution condition of the EGR (for example, the speed and a fuel injection amount of the internal combustion engine 50), a parameter that affects an execution condition of the EGR (for example, the intake air/exhaust gas temperature or the intake air/exhaust gas pressure), or an execution period of the EGR can be used.

The specified position can be set in a portion where the condensed water produced in the EGR cooler 42 is likely to stay, for example. Thus, the passage wall temperature described above is specifically a passage wall temperature of the EGR cooler 42, for example. In regard to this point, even after the internal combustion engine 50 is warmed up, for example, the condensed water can be produced in the EGR cooler 42 by a reduction in the passage wall temperature in a period when the EGR is not executed. In addition, in a case where the vehicle 100 is the vehicle that performs the idle stop or the hybrid vehicle, the passage wall temperature of the EGR cooler 42 is reduced while the internal combustion engine 50 is stopped during the continuous operation of the vehicle 100. Consequently, the condensed water can be produced.

Thus, as the parameter that affects the increasing amount, the operation state of the internal combustion engine 50 can further be configured by having, for example, the temperature of the intake air in the internal combustion engine 50, the vehicle speed, an EGR stop period, or a stop period of the internal combustion engine 50 during the continuous operation of the vehicle 100. In regard to this point, the operation state of the internal combustion engine 50 may further includes the operation state of the vehicle 100 that includes the internal combustion engine 50. Alternatively, the operation state of the internal combustion engine 50 may be set as the operation state of the vehicle 100 that includes the operation state of the internal combustion engine 50.

Meanwhile, a degree of increase of the condensed water is changed in accordance with a ratio of the moisture contained in the EGR gas. In addition, the ratio of the moisture contained in the EGR gas is changed in accordance with a density of the EGR gas. Furthermore, the density of the EGR gas is changed in accordance with the intake air/exhaust gas temperature or the intake air/exhaust gas pressure. Thus, as a parameter that affects the degree of increase of the condensed water, the operation state of the internal combustion engine 50 can be configured by having the intake air/exhaust gas temperature and the intake air/exhaust gas pressure, for example.

When the amount of the condensed water is estimated, the operation state of the internal combustion engine 50 is not necessarily limited to those described above. For example, the operation state of the internal combustion engine 50 may be configured by having an additional appropriate parameter, for example, that is, may be configured by having an appropriate parameter that does not match the those parameters described above. Meanwhile, the amount of the condensed water may completely be estimated by the arithmetic expression, for example. Alternatively, the amount of the condensed water may be estimated by a combination of the arithmetic expression and the map data.

The amount of the condensed water is not necessarily limited to the amount of the condensed water at the specified position, but may be an approximate amount of the condensed water in the entire EGR passage, for example. This is because, even in such a case, the arrival position of the condensed water tends to be closer to the internal combustion engine 50 as the amount of the condensed water as a whole in the EGR passage is increased. The amount of the condensed water in the entire EGR passage can also be set in advance as map data in accordance with the operation state of the internal combustion engine 50, for example.

As described above, a flow velocity estimating section that estimates the flow velocity u and a condensed water amount estimating section that estimates the amount of the condensed water are further realized in the ECU 70. The flow velocity estimating section estimates the flow velocity u at least either at the time of acceleration or at the time of deceleration of the internal combustion engine 50. Specifically, the flow velocity estimating section can estimate the flow velocity u that becomes the maximum during acceleration at the time of acceleration and the flow velocity u that becomes the maximum during deceleration at the time of deceleration.

In regard to this point, at the time of deceleration, the flow velocity estimating section estimates the flow velocity u at the time of initiation of deceleration on the basis of the output of the airflow meter 11, the intake air/exhaust gas temperature sensors 61, 63, and the intake air/exhaust gas pressure sensors 62, 64. Accordingly, the flow velocity estimating section can estimate the flow velocity u that becomes the maximum during deceleration on the basis of the estimated flow velocity u at the time of the initiation of deceleration. At the time of acceleration, the flow velocity estimating section can estimate the flow velocity u at the time of initiation of acceleration on the basis of the output of these sensors, and can also estimate the flow velocity u that becomes the maximum during acceleration on the basis of further a degree of an acceleration request, for example, in addition to the estimated flow velocity u at the time of the initiation of acceleration.

The condensed water amount estimating section estimates the amount of the condensed water at least either at the time of acceleration or at the time of deceleration of the internal combustion engine 50. The condensed water amount estimating section can specifically estimate the amount of the condensed water at the time of the initiation of acceleration during acceleration of the internal combustion engine 50 and the amount of the condensed water at the time of the initiation of deceleration during deceleration of the internal combustion engine 50.

Thus, the arrival position determining section further specifically estimates the arrival position of the condensed water on the basis of the flow velocity u estimated by the flow velocity estimating section and the amount of the condensed water estimated by the condensed water amount estimating section. In addition, the arrival position determining section determines whether the estimated arrival position is on the upstream side of the EGR valve 43. When the estimated arrival position is the EGR valve 43, the position can be included as either the upstream side or the downstream side of the EGR valve 43.

Instead of determining whether the estimated arrival position is on the upstream side of the EGR valve 43, the arrival position determining section may determine whether the arrival position is on an upstream side of a merging point of the EGR pipe 41 and the intake system 10, for example. In addition, instead of the flow velocity u, the arrival position may be estimated on the basis of an EGR ratio, for example. The EGR ratio is a ratio of an amount of the EGR gas as a part of a total amount of the gas that is suctioned into the cylinder of the internal combustion engine 50. In this case, instead of the flow velocity estimating section, an EGR ratio estimating section that estimates the EGR ratio can be realized. Then, the arrival position determining section can estimate the arrival position on the basis of the EGR ratio that is estimated by the EGR ratio estimating section, instead of the flow velocity u that is estimated by the flow velocity estimating section.

The EGR ratio estimating section can estimate the total amount of the gas that is suctioned into the cylinder of the internal combustion engine 50 on the basis of the pressure, the volume, or the temperature that can be detected or estimated, for example, and thus can estimate the EGR ratio on the basis of the estimated total amount of the gas and a detectable amount of the fresh air. Similar to the flow velocity estimating section, the EGR ratio estimating section can estimate the EGR ratio at the time of the initiation of acceleration during acceleration and can further estimate the EGR ratio that becomes the maximum during acceleration, for example. In addition, similar to the flow velocity estimating section, the EGR ratio estimating section can estimate the EGR ratio at the time of the initiation of deceleration during deceleration and can further estimate the EGR ratio that becomes the maximum during deceleration.

In the ECU 70, an adhesion determining section is further realized that determines whether the condensed water is adhered in the EGR passage before the arrival position determining section determines the arrival position. Thus, further specifically, the arrival position determining section determines the arrival position of the condensed water when the adhesion determining section determines that the condensed water is adhered. The adhesion determining section specifically determines whether the condensed water is adhered on the basis of the amount of the condensed water that is estimated by the condensed water amount estimating section. In addition, the adhesion determining section determines that the condensed water is adhered when the amount of the condensed water that is estimated by the condensed water amount estimating section is not zero. A determination on whether the condensed water is adhered may be made by the arrival position determining section, for example.

In the ECU 70, a control section that controls at least one of the EGR valve 43 and the diesel throttle 13 is further realized on the basis of the arrival position that is determined by the arrival position determining section. The control section specifically controls at least one of the EGR valve 43 and the diesel throttle 13 such that the flow velocity u becomes lower than a specified value.

In regard to this point, the EGR valve 43 and the diesel throttle 13 constitute the flow rate change section that can change at least one of the flow rate of the EGR gas and the flow rate of the fresh air that flows into the internal combustion engine 50. Then, for control of the flow rate change section that is configured by having a plurality of configurations, the control section can control at least one of the various configurations that constitute the flow rate change section.

The control section specifically adjusts the flow rate of the EGR gas by controlling the EGR valve 43 when the arrival position determining section determines that the arrival position is on the upstream side of the EGR valve 43. At this time, the control section also adjusts the flow rate of the EGR gas such that the flow velocity u1 becomes lower than a specified value α. In regard to this point, specifically, a flow velocity of the EGR gas that is distributed in a portion on the upstream side of the EGR valve 43 in the EGR pipe 41 is specifically reflected as the flow velocity u1 due to the arrangement of the EGR valve 43. Thus, further specifically, for adjustment of the flow rate of the EGR gas just as described, the control section controls the EGR valve 43 to reduce a degree of valve opening thereof.

When the arrival position determining section determines that the arrival position is on the downstream side of the EGR valve 43, the control section controls the EGR valve 43 and the diesel throttle 13, and thereby adjusts the flow rate of the EGR gas and the flow rate of the fresh air. At this time, the control section also adjusts the flow rate of the EGR gas and the flow rate of the fresh air such that the flow velocity u1 becomes lower than a specified value α2 and that the flow velocity u2 becomes lower than a specified value β.

In regard to this point, the mixed gas of the EGR gas and the fresh air is distributed in a portion on a downstream side of the diesel throttle 13 in the intake system 10. Thus, further specifically, for adjustment of the flow rate of the EGR gas and the flow rate of the fresh air just as described, the control section controls the EGR valve 43 to reduce the degree of valve opening thereof, and also controls the diesel throttle 13 to increase a degree of valve opening thereof. The specified value α1 and the specified value α2 may be the same.

When either one of the flow rate of the EGR gas and the flow rate of the fresh air is changed, the other may be changed due to influence of the change. In regard to this point, the EGR valve 43 that constitutes the flow rate change section specifically constitutes a recirculate amount changing section that can change the flow rate of the EGR gas in the EGR passage. In addition, the diesel throttle 13 that constitutes the flow rate change section constitutes a fresh air amount changing section that can change the flow rate of the fresh air in at least one of the intake system 10 and the exhaust system 20.

Since the flow rate change section specifically includes the recirculate amount changing section and the fresh air amount changing section, the flow rate change section is configured to be able to change at least one of the flow rate of the EGR gas and the flow rate of the fresh air. In regard to this point, the present invention allows a change in the flow rate of the fresh air due to the influence of a change in the flow rate of the EGR gas made by the recirculate amount changing section of the flow rate change section, for example. The same can be said for the case where the fresh air amount changing section of the flow rate change section changes the flow rate of the fresh air.

Further specifically, the EGR valve 43 constitutes the recirculate amount changing section together with the bypass valve 45. In regard to this, when the control section controls the EGR valve 43, further specifically, the control section at least controls the EGR valve 43 out of the EGR valve 43 and the bypass valve 45.

In regard to this point, for control of the recirculate amount changing section that is configured by having a plurality of configurations, the control section can control at least one of the various configurations that constitute the recirculate amount changing section. The same can be said for the fresh air amount changing section. When two or more of the configurations out of the various configurations that constitute the recirculate amount changing section (or the fresh air amount changing section) are controlled, timing to control these configurations may differ from each other. The same can be said for a case where, in addition to the control of at least one of various configurations that constitute the recirculate amount changing section, at least one of the various configurations that constitute the fresh air amount changing section is also controlled for the control of the flow rate change section.

In regard to the control timing, for example, during deceleration of the internal combustion engine 50 that is accompanied by fuel cut, the control section can control the bypass valve 45 upon necessity from the time of the initiation of deceleration to the time of the initiation of fuel cut, and can also control the EGR valve 43 at the time of the initiation of fuel cut. During acceleration of the internal combustion engine 50, the control section can execute control at the time of the initiation of acceleration. In regard to this point, an appropriate description will hereinafter be made on further specific control by the control section including the control timing.

In this embodiment, a flow rate controller of the internal combustion engine (hereinafter referred to as the flow rate controller) that includes the diesel throttle 13, the EGR valve 43, the bypass valve 45, and the ECU 70 is realized.

Figure 3:
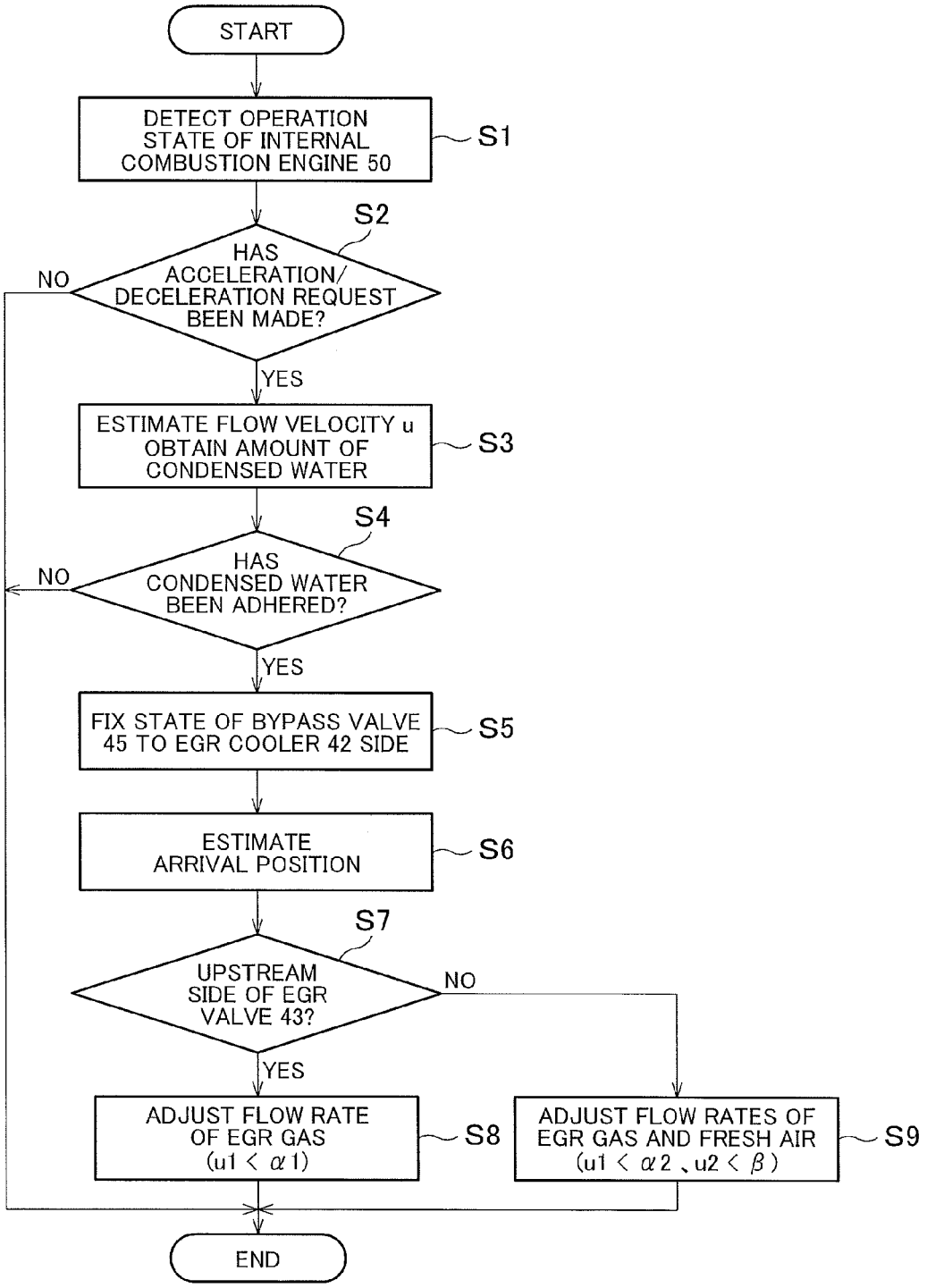
FIG. 3 shows a flowchart of an example of control by an ECU.

Next, an example of a control operation of the ECU 70 will be described by using a flowchart shown in FIG. 3. The ECU 70 detects the operation state of the internal combustion engine 50 (step S1), and determines whether an acceleration/deceleration request of the internal combustion engine 50 has been made (step S2). Whether the acceleration/deceleration request has been made can be determined on the basis of the output of the accelerator pedal operation amount sensor, for example. When the determination is negative, this flowchart is terminated once. When the determination is positive, the ECU 70 estimates the flow velocity u and obtains the amount of the condensed water (step S3). In regard to this point, separately from this flowchart, the amount of the condensed water is estimated as needed. In step S3, following the positive determination in step S2, the amount of the condensed water, which is estimated as needed, is obtained.

Following the positive determination in step S2, the flow velocity u is estimated, and the amount of the condensed water is obtained in step S3. Thus, the flow velocity u and the amount of the condensed water at the time of the initiation of acceleration or at the time of the initiation of deceleration of the internal combustion engine 50 are estimated. In regard to this point, whether it is the time of the initiation of deceleration of the internal combustion engine 50, which is accompanied by fuel cut, can be determined by further determining in step S2, whether an execution condition for fuel cut control of the internal combustion engine 50 (for example, that the vehicle speed is higher than a specified value, that the degree of the acceleration request immediately before deceleration is higher than a specified degree, or the like) is satisfied, for example. In step S3, the ECU 70 further specifically estimates the flow velocity u that becomes the maximum during acceleration at the time of acceleration or estimates the flow velocity u that becomes the maximum during deceleration at the time of deceleration.

Following step S3, the ECU 70 determines whether the condensed water has been adhered on the basis of the estimated amount of the condensed water (step S4). When the determination is negative, this flowchart is terminated once. In this case, conventional control can be executed. When the determination is positive in step S4, the ECU 70 fixes a state of the bypass valve 45 to the EGR cooler 42 side (step S5).

In regard to this point, when the bypass valve 45 preferentially distributes the exhaust gas to the EGR cooler 42, the ECU 70 specifically retains the state of the bypass valve 45 as is in step S5. On the other hand, when the bypass valve 45 preferentially distributes the exhaust gas to the bypass pipe 44, the ratio of valve opening occupied by the EGR cooler 42 side is increased to be larger than the ratio of valve opening occupied by the bypass pipe 44 side. Thus, for control of the bypass valve 45, specifically, when it is determined that the condensed water has been adhered, the control section can control the bypass valve 45 upon necessity, just as described.

Next, the ECU 70 estimates the arrival position on the basis of the estimated flow velocity u and the obtained amount of the condensed water (step S6). In addition, the ECU 70 determines whether the estimated arrival position is on the upstream side of the EGR valve 43 (step S7). The arrival position may be estimated following step S3, for example. When the determination is positive in step S7, the ECU 70 adjusts the flow rate of the EGR gas such that the flow velocity u1 becomes lower than the specified value $\alpha 1$ (step S8). At this time, the ECU 70 specifically controls the EGR valve 43 to reduce the degree of valve opening.

When the determination is negative in step S7, the ECU 70 adjusts the flow rate of the EGR gas and the flow rate of the fresh air such that the flow velocity u2 becomes lower than the specified value $\alpha 2$ and that the flow velocity u2 becomes lower than the specified value $\beta$ (step S9). At this time, specifically, the ECU 70 controls the EGR valve 43 to reduce the degree of valve opening, and also controls the diesel throttle 13 to increase the degree of valve opening. This flowchart is terminated once after step S8 or S9.

Figure 4:
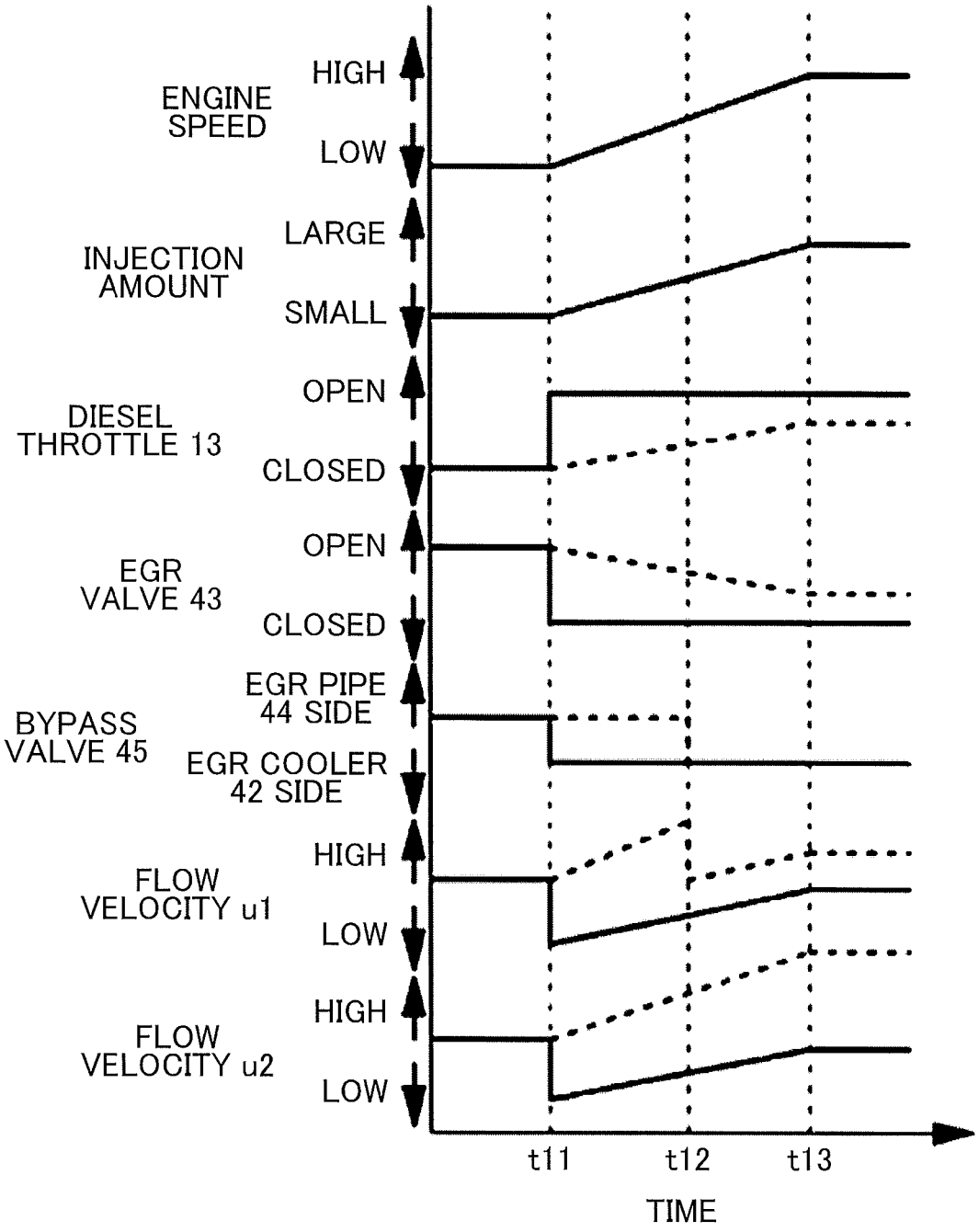
FIG. 4 is a graph for showing an example of changes in various parameters at the time of acceleration.
Figure 5:
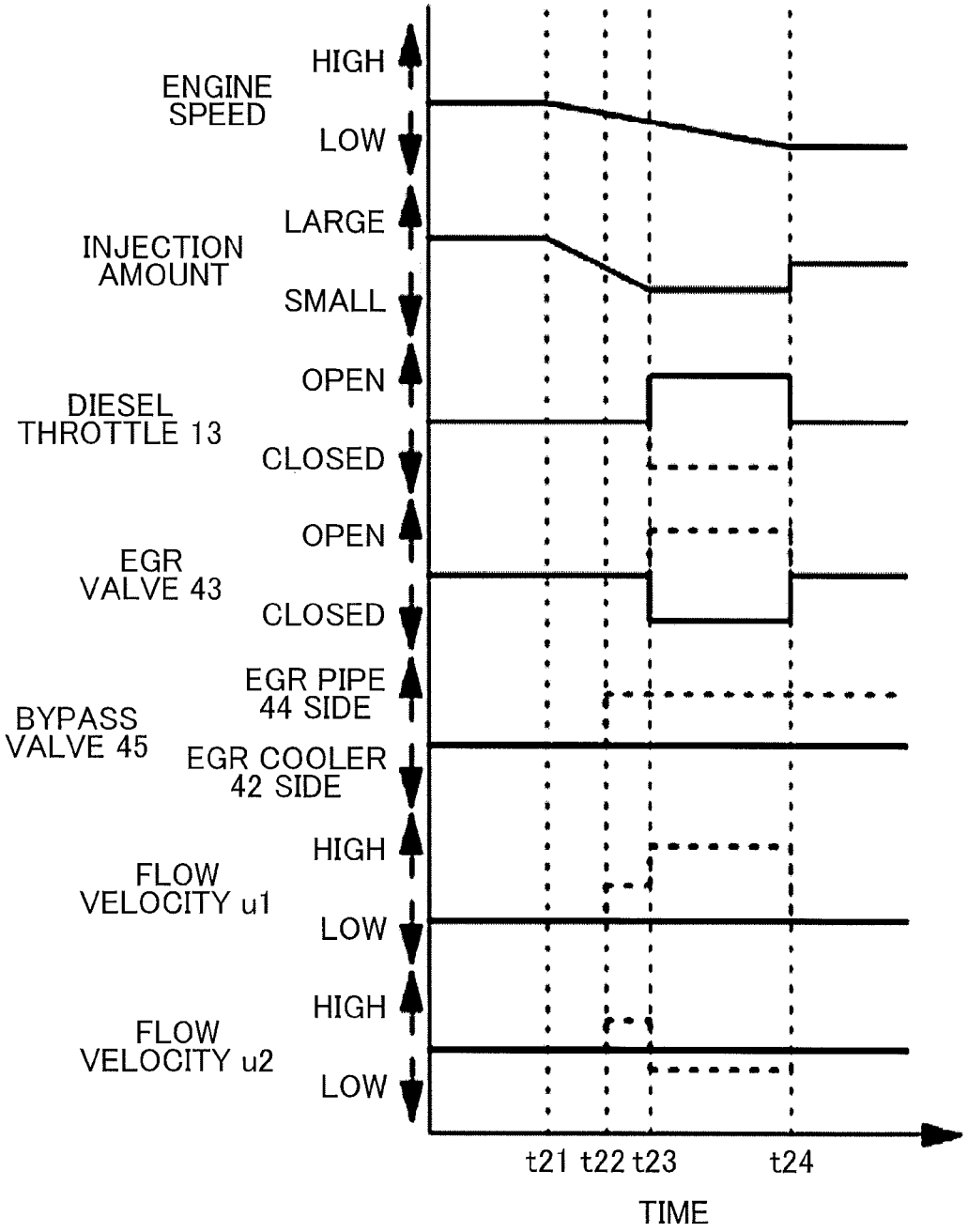
FIG. 5 is a graph for showing an example of changes in the various parameters at the time of deceleration.

Next, a description will be made on an example of changes in various parameters that correspond to the flowchart shown in FIG. 3. FIG. 4 is a graph for showing an example of changes in the various parameters at the time of acceleration of the internal combustion engine 50. FIG. 5 is a graph for showing an example of changes in the various parameters at the time of deceleration of the internal combustion engine 50. FIG. 4 and FIG. 5 show the example of changes when it is determined that the arrival position of the condensed water is on the downstream side of the EGR valve 43. In FIG. 4 and FIG. 5, broken lines indicate the example of changes in a case where the conventional control is executed, and solid lines indicate the example of changes in a case where the ECU 70 executes the control. In regard to this point, the control section can execute the conventional control when it is determined that the condensed water has not been adhered. FIG. 4 and FIG. 5 show the speed of the internal combustion engine 50, the fuel injection amount, a state of the diesel throttle 13, a state of the EGR valve 43, the state of the bypass valve 45, and the flow velocities u1, u2 as the various parameters.

In the example shown in FIG. 4, acceleration is initiated at a time t11, and acceleration is terminated at a time t13. Thus, in this case, the engine speed is increased, and the fuel injection amount is increased from the time t11 to the time t13. In regard to this point, in the conventional control, the diesel throttle 13, the EGR valve 43, and the bypass valve 45 are controlled as follows, for example.

More specifically, the diesel throttle 13 is controlled such that the degree of valve opening thereof is gradually increased from the time t11 (that is, from the time of the initiation of acceleration) in correspondence with the degree of the acceleration request. The EGR valve 43 is controlled such that the degree of valve opening thereof is gradually reduced from the time t11 in correspondence with the degree of the acceleration request. Regarding the bypass valve 45, the ratio of valve opening occupied by the EGR cooler 42 side is increased to be larger than the ratio of valve opening occupied by the bypass pipe 44 side from the time of the initiation of acceleration, which is indicated as the time t12, to the time of the termination of acceleration. Accordingly, the state of the bypass valve 45 is fixed to the EGR cooler 42 side with the wider passage.

Thus, in this case, the flow velocities u1, u2 are changed as follows. That is, the flow velocity u1 is gradually increased from the time t11 to the time t12. In addition, the flow velocity u1 is reduced once at the time t12 and is gradually increased from the time t12 to a time t13. The flow velocity u2 is gradually increased from the time t11 to the time t13. Consequently, the flow velocity u1 may be increased to be larger than the specified value $\alpha 2$ in this case. In addition, the flow velocity u2 may be increased to be larger than the specified value $\beta$.

Regarding this, the ECU 70 controls the diesel throttle 13, the EGR valve 43, and the bypass valve 45 as follows. That is, the diesel throttle 13 is controlled by the control section such that the degree of valve opening is increased by a specified degree that corresponds to the degree of the acceleration request at the time t11 (that is, at the time of the initiation of acceleration). The EGR valve 43 is controlled by the control section such that the degree of valve opening is reduced by a specified degree that corresponds to the degree of the acceleration request at the time t11. Regarding the bypass valve 45, the control section increases the ratio of valve opening occupied by the EGR cooler 42 side at the time t11, so as to be larger than the ratio of valve opening occupied by the bypass pipe 44 side.

Thus, in this case, the flow velocities u1, u2 are changed as follows. That is, the flow velocities u1, u2 are both immediately reduced at the time $\alpha 1$ and are gradually increased from the time t11 to the time t13. Also, in this case, since the bypass valve 45 is fixed to the EGR cooler 42 side at the time t11, the flow velocities u1, u2 are gradually increased from the time t11. Consequently, in this case, the flow velocity u1 can be reduced to be lower than the specified value $\alpha 2$, and the flow velocity u2 can be reduced to be lower than the specified value $\beta$.

In the example shown in FIG. 5, deceleration is initiated at a time t21, and deceleration is terminated at a time t24. In addition, fuel cut is initiated at a time t23. Thus, in this case, the engine speed and the fuel injection amount are changed as follows. That is, the engine speed is gradually reduced from the time t21 to the time t24. The fuel injection amount is gradually reduced from the time t21 to be zero. Then, after becoming zero from the time t23 to the time t24, the fuel injection amount is increased at the time t24. In regard to this point, in the conventional control, for example, the diesel throttle 13, the EGR valve 43, and the bypass valve 45 are controlled as follows.

That is, the diesel throttle 13 is controlled such that the degree of valve opening is reduced by a specified degree at the time t23 (that is, at the time of the initiation of fuel cut). The EGR valve 43 is controlled such that the degree of valve opening is increased by a specified degree at the time t23. Accordingly, during fuel cut, the inflow of the fresh air is suppressed, and the EGR is actively performed to suppress a temperature reduction of the catalyst 22. Regarding the bypass valve 45, the ratio of valve opening occupied by the bypass pipe 44 side is increased to be larger than the ratio of valve opening occupied by the EGR cooler 42 side from the time of the initiation of deceleration, which is indicated as the time t22, to the time of the initiation of fuel cut.

Thus, in this case, the flow velocities u1, u2 are changed as follows. That is, the flow velocity u1 is increased at the times t22, t23 and reduced at the time t24. The flow velocity u2 is increased at the time t22, reduced at the time t23, and further increased at the time t24. Consequently, in this case, at least the flow velocity u1 out of the flow velocities u1, u2 may be increased to be higher than the specified value $\alpha 2$. Also, in this case, if only the EGR valve 43 out of the diesel throttle 13 and the EGR valve 43 is further closed, for example, in order to reduce the flow velocity u1, the flow velocity u2 is in turn increased significantly. Consequently, the flow velocity u2 can be increased to be higher than the specified value $\beta$.

Regarding this, the ECU 70 controls the diesel throttle 13, the EGR valve 43, and the bypass valve 45 as follows. That is, the diesel throttle 13 is controlled by the control section such that the degree of valve opening is increased by a specified degree at the time t23. The EGR valve 43 is controlled by the control section such that the degree of valve opening is reduced by a specified degree at the time t23. Regarding the bypass valve 45, the state of the bypass valve 45 is retained. Consequently, in this case, since fluctuations in the flow velocities u1, u2 are suppressed, the flow velocity u1 can be reduced to be lower than the specified value $\alpha 2$, and the flow velocity u2 can be reduced to be lower than the specified value $\beta$.

Next, main effects of the flow rate controller of this embodiment will be described. The flow rate controller of this embodiment determines the arrival position of the condensed water in the EGR passage that is moved by the EGR at least either at the time of acceleration or at the time of deceleration. In addition, the flow rate controller of this embodiment controls at least one of the EGR valve 43 and the diesel throttle 13 on the basis of the determined arrival position. When controlling the EGR valve 43, the flow rate controller of this embodiment at least controls the EGR valve 43 out of the EGR valve 43 and the bypass valve 45.

Accordingly, when it is determined that the arrival position is on the upstream side of the EGR valve 43, at least the EGR valve 43 out of the EGR valve 43 and the bypass valve 45 is controlled such that the flow velocity u1 is reduced to be lower than the specified value $\alpha 1$. Thus, it is possible to suppress the condensed water from flowing into the cylinder of the internal combustion engine 50.

In addition, when the arrival position is on the downstream side of the EGR valve 43, at least the EGR valve 43 out of the EGR valve 43 and the bypass valve 45 is controlled such that the flow velocity u1 is reduced to be lower than the specified value $\alpha 2$ and that the flow velocity u2 is reduced to be lower than the specified value $\beta$, and the diesel throttle 13 is also controlled. Thus, it is possible to suppress the condensed water from flowing into the cylinder of the internal combustion engine 50.

At the time of deceleration of the internal combustion engine 50 that is accompanied by fuel cut, the inflow of the fresh air during fuel cut is suppressed, and the EGR is actively performed. Thus, the temperature reduction in the catalyst 22 can be suppressed. However, in this case, since the flow velocity u1 and the flow velocity u2 are increased as described above, a possibility that the condensed water flows into the cylinder of the internal combustion engine 50 is increased. Consequently, in this case, instead of suppressing the temperature reduction in the catalyst 22, various parts in the cylinder of the internal combustion engine 50 is likely to be corroded. On the other hand, the flow rate controller of this embodiment preferentially suppresses the inflow of the condensed water when suppressing the temperature reduction of the catalyst 22 at the time of deceleration of the internal combustion engine 50 that is accompanied by fuel cut. Thus, the flow rate controller of this embodiment can also preferentially suppress the various parts in the cylinder of the internal combustion engine 50 from being likely to be corroded.

The flow rate controller of this embodiment can be configured by specifically including the EGR device 40 and that the flow rate change section is configured by having at least one of the EGR valve 43 and the bypass valve 45 (for example, the EGR valve 43 and the bypass valve 45). In other words, the flow rate controller of this embodiment can be configured to adjust the flow rate of the EGR gas by controlling not only the EGR valve 43 but also the bypass valve 45, for example. Accordingly, at the time of acceleration of the internal combustion engine 50, for example, the flow velocity u1 can be reduced to be lower than the specified value $\alpha 2$, and the flow velocity u2 can be reduced to be lower than the specified value $\beta$.

In addition, the flow rate controller of this embodiment can be configured that the flow rate change section is configured by having at least one of the diesel throttle 13 and the supercharger 30 (for example, the diesel throttle 13 and the supercharger 30). In other words, the flow rate controller of this embodiment can be configured to adjust the flow rate of the fresh air by controlling not only the diesel throttle 13 but also the supercharger 30, for example. Accordingly, when the degree of valve opening of the diesel throttle 13 is increased, for example, it is also possible to prevent an intake air pressure from being abruptly changed.

Meanwhile, the flow rate of the fresh air can also be adjusted by an exhaust throttle valve that can adjust the flow rate of the exhaust gas discharged from the internal combustion engine 50, for example. Thus, the flow rate controller of this embodiment can be configured that the flow rate change section is further specifically configured by having at least one of the diesel throttle 13, the supercharger 30, and the exhaust throttle valve. In regard to this point, the exhaust throttle valve can be used to adjust the flow rate of the fresh air when the diesel throttle 13 is not provided, for example.

When a bypass passage section that bypasses the inter cooler 12 and a bypass valve that can control a distribution passage between the bypass passage section and the inter cooler 12 are further provided, the flow rate change section may be configured by further having the bypass valve, for example. The bypass valve can constitute the fresh air amount changing section.

In this case, for example, when it is determined that the condensed water has been adhered, the state of the bypass valve can be fixed to the inter cooler 12 side with a wider passage than the bypass passage section. The bypass valve can be a bypass valve that adjustably switches the distribution passage to at least one of the bypass passage and the inter cooler 12. The flow rate change section may be configured by having another appropriate configuration, so that it may be controlled such that the flow velocity u is reduced to be lower than a specified value.

The EGR valve 43 may be provided in a portion on the upstream side (for example, an end portion on the upstream side) in the EGR pipe 41. Accordingly, the flow velocity of the EGR gas that is distributed in a portion on the downstream side of the EGR valve 43 may be reflected to the flow velocity u1. The portion in which the EGR valve 43 is provided can be a portion on the upstream side of the EGR cooler 42 in the EGR pipe 41.

In this case, the arrival position determining section can determine whether the estimated arrival position is on the upstream side of a merging point of the EGR pipe 41 and the intake system 10. When the arrival position determining section determines that the arrival position is on the upstream side of the merging point, the control section can control the EGR valve 43 to increase the degree of valve opening thereof, for example. On the other hand, when the arrival position determining section determines that the arrival position is not on the upstream side of the merging point, the control section can control the EGR valve 43 to increase the degree of valve opening, for example, and can also control the diesel throttle 13 to increase the degree of valve opening thereof.

However, in this case, there is a possibility that the flow velocity u1 cannot sufficiently be reduced. In addition, such inconvenience as that the degree of valve opening of the EGR valve 43 cannot be reduced at the time of acceleration of the internal combustion engine 50 occurs. In regard to this point, since the EGR valve 43 is configured to be provided in the portion on the downstream side (more specifically, at the end portion on the intake system 10 side) in the EGR pipe 41, the flow rate controller of this embodiment can also suppress the condensed water from flowing into the cylinder of the internal combustion engine 50 in a favorable manner, from a viewpoint of compatibility to a changing aspect of the flow velocity u as well as to the operation of the internal combustion engine 50.

Furthermore, the following can be said for the arrangement of the EGR valve 43. That is, the condensed water is likely to be produced in the EGR cooler 42 due to the configuration thereof to cool the EGR gas. As for the condensed water that flows into the cylinder of the internal combustion engine 50, the condensed water produced in the EGR cooler 42 has a large influence on corrosion of the various parts in the cylinder. Considering the above, further specifically, since the EGR valve 43 is configured to be provided in the portion on the downstream side of the EGR cooler 42, the flow rate controller of this embodiment can also suppress the condensed water from flowing into the cylinder of the internal combustion engine 50 in a favorable manner.

The internal combustion engine 50 includes the fuel injection valve 55 that directly injects the fuel into the cylinder. In regard to this point, since the condensed water flows into the cylinder in the internal combustion engine 50, there is a possibility that the various parts in the cylinder are likely to be corroded.

When the vehicle 100 in which the internal combustion engine 50 is mounted is either the vehicle that performs the idle stop or the hybrid vehicle, the internal combustion engine 50 is frequently stopped during traveling of the vehicle 100. In this case, the internal combustion engine 50 keeps being cooled during stop thereof, and consequently, the condensed water is likely to be produced and stay in the EGR passage. Accordingly, the condensed water is particularly likely to flow into the cylinder of the internal combustion engine 50. Thus, the flow rate controller of this embodiment is suited when the vehicle 100 in which the internal combustion engine 50 is mounted is either the vehicle that performs the idle stop or the hybrid vehicle.

The embodiment of the present invention has been described in detail so far. However, the present invention is not limited to the particular embodiment, but various modifications and changes can be made thereto within the scope of the gist of the present invention that is described in the claims.

For example, the arrival position determining section may appropriately be provided with a sensor that can detect adhesion of the condensed water and detect the arrival position of the condensed water on the basis of output of the sensor, so as to determine the arrival position of the condensed water. However, in this case, after the actual arrival position is detected, the inflow of the condensed water into the cylinder is suppressed, for example. Thus, an effect of suppressing the inflow of the condensed water may be degraded.

DESCRIPTION OF THE REFERENCE NUMERALS AND SYMBOLS

DIESEL THROTTLE/13
TURBOCHARGER/30
EGR DEVICE/40
EGR COOLER/42
EGR VALVE/43
INTERNAL COMBUSTION ENGINE/50
ECU/70

The invention claimed is:

1. A flow rate controller of an internal combustion engine, the flow rate including a flow rate of exhaust gas that is recirculated to an intake system from an exhaust system of the internal combustion engine via an EGR passage and a flow rate of fresh air that flows into the internal combustion engine, the flow rate controller comprising:

a flow rate change section configured to change at least one of the flow rate of the exhaust gas and the flow rate of the fresh air; and an electronic control unit configured to:

(a) determine an arrival position of condensed water in the EGR passage at least either at the time of acceleration or at the time of deceleration of the internal combustion engine, the condensed water being moved in the EGR passage by EGR, and (b) control the flow rate change section on the basis of the arrival position.

2. The flow rate controller according to claim 1, wherein of the time of acceleration and the time of deceleration of the internal combustion engine, the electronic control unit determines the arrival position of the condensed water at the time of deceleration of the internal combustion engine that is accompanied by fuel cut.

3. The flow rate controller according to claim 1, further comprising:

an EGR device wherein of the EGR passage, a recirculate passage, a flow rate adjusting valve, a cooler, a bypass passage, and a bypass valve, the EGR device at least includes the recirculate passage, the flow rate adjusting valve, and the cooler, the recirculate passage is configured to connect the exhaust system and the intake system, the flow rate adjusting valve is configured to adjust a flow rate of the exhaust gas flowing into the intake system via the recirculate passage, the cooler is configured to cool the exhaust gas distributed in the recirculate passage, the bypass passage is configured to bypass the cooler out of the flow rate adjusting valve and the cooler, and the bypass valve is configured to bypass the cooler out of the cooler and the bypass passage, and wherein the flow rate change section has at least one of the flow rate adjusting valve and the bypass valve, and also has at least one of a throttle valve, an exhaust driven and variable capacity turbocharger, and an exhaust throttle valve, the throttle valve is configured to adjust an intake air amount of the internal combustion engine, the exhaust driven and variable capacity turbocharger is configured to supercharge the internal combustion engine, and an exhaust throttle valve is configured to adjust a flow rate of the exhaust gas discharged from the internal combustion engine.

4. The flow rate controller according to claim 2 further comprising an EGR device, of the EGR passage, a recirculate passage, a flow rate adjusting valve, a cooler, a bypass passage, and a bypass valve, the EGR device at least including the recirculate passage, the flow rate adjusting valve, and the cooler, the recirculate passage being configured to connect the exhaust system and the intake system, the flow rate adjusting valve being configured to adjust a flow rate of exhaust gas flowing into the intake system via the recirculate passage, the cooler being configured to cool the exhaust gas distributed in the recirculate passage, the bypass passage being configured to bypass the cooler out of the flow rate adjusting valve and the cooler, and the bypass valve being configured to bypass the cooler out of the cooler and the bypass passage, wherein the flow rate change section has at least one of the flow rate adjusting valve and the bypass valve and also has at least one of a throttle valve, an exhaust driven and variable capacity turbocharger, and an exhaust throttle valve, the throttle valve is configured to adjust an intake air amount of the internal combustion engine, the exhaust driven and variable capacity turbocharger is configured to supercharge the internal combustion engine, and the exhaust throttle valve is configured to adjust a flow rate of the exhaust gas discharged from the internal combustion engine.

5. The flow rate controller according to claim 3 wherein when the electronic control unit determines that the arrival position of the condensed water is determined to be on an upstream side of the flow rate adjusting valve, the electronic control unit reduces a degree of opening of the adjusting valve to be smaller than a degree of opening of the adjusting valve at the time when the condensed water is not adhered to the inside of the EGR passage, and when the electronic control unit determines that the arrival position of the condensed water is determined to be on a downstream side of the flow rate adjusting valve, the electronic control unit reduces the degrees of opening of the adjusting valve and the throttle valve to be smaller than the degrees of opening of the adjusting valve and the throttle valve at the time when the condensed water is not adhered to the inside of the EGR passage.

6. The flow rate controller according to claim 4 wherein when the electronic control unit determines that the arrival position of the condensed water is determined to be on an upstream side of the flow rate adjusting valve, the electronic control unit reduces a degree of opening of the adjusting valve to be smaller than a degree of opening of the adjusting valve at the time when the condensed water is not adhered to the inside of the EGR passage, and when the electronic control unit determines that the arrival position of the condensed water is determined to be on a downstream side of the flow rate adjusting valve, the electronic control unit reduces the degrees of opening of the adjusting valve and the throttle valve to be smaller than the degrees of opening of the adjusting valve and the throttle valve at the time when the condensed water is not adhered to the inside of the EGR passage.

7. A method of controlling a flow rate of an internal combustion engine, the flow rate including a flow rate of exhaust gas that is recirculated to an intake system from an exhaust system of the internal combustion engine via an EGR passage and a flow rate of fresh air that flows into the internal combustion engine, the flow rate controller having a flow rate change section and an electronic control unit, the flow rate change section configured to change at least one of the flow rate of the exhaust gas and the flow rate of the fresh air, the method comprising:

(a) determining an arrival position of condensed water by the electronic control unit at least either at the time of acceleration or at the time of deceleration of the internal combustion engine, the condensed water being moved in the EGR passage by EGR; and (b) controlling the flow rate change section by the electronic control unit on the basis of the arrival position.

* * * * *